United States Patent [19]

Hildebrand et al.

[11] Patent Number: 4,764,774

[45] Date of Patent: Aug. 16, 1988

[54] ERODIBLE BURIED RADIO FREQUENCY TRANSMITTING AND RECEIVING ANTENNA

[76] Inventors: Verne E. Hildebrand, 1133 Savoy St., San Diego, Calif. 92107; Elwin W. Seeley, 5047 Randall St., San Diego, Calif. 92109

[21] Appl. No.: 916,953

[22] Filed: Oct. 8, 1986

[51] Int. Cl.[4] ..... H01Q 1/04

[52] U.S. Cl. ..... 343/719; 343/826; 343/897

[58] Field of Search ..... 343/719, 791, 826, 873, 343/897, 844, 853; 361/66, 68

[56] References Cited

U.S. PATENT DOCUMENTS

| | | | |
|---|---|---|---|
| 3,183,510 | 5/1965 | Rawls | 343/719 |
| 3,290,688 | 12/1966 | Kraus | 343/897 X |
| 3,334,347 | 8/1967 | Wilkinson | 343/719 |
| 3,346,864 | 10/1967 | Harmon | 343/719 |
| 3,435,457 | 3/1969 | Brueckmann | 343/719 |
| 3,594,798 | 7/1971 | Leydorf et al. | 343/719 |
| 3,680,113 | 7/1972 | Dorier et al. | 343/876 X |
| 3,680,133 | 7/1972 | Tsao et al. | 343/719 |
| 3,742,509 | 6/1973 | DeBettencourt et al. | 343/719 |
| 3,775,772 | 11/1973 | Carrell | 343/719 |
| 4,017,863 | 4/1977 | Tharp et al. | 343/719 |

*Primary Examiner*—Eugene R. LaRoche
*Assistant Examiner*—Seung Ham
*Attorney, Agent, or Firm*—Allen A. Dicke, Jr.

[57] ABSTRACT

Radio frequency antenna is buried in the earth with its top substantially flush with the surface with a significant portion of the antenna buried therebelow. The antenna is configured so that, if much of the top is removed, as by blast, the remaining portion of the antenna remains operative without significant functional deterioration.

15 Claims, 5 Drawing Sheets

ERODIBLE BURIED RADIO FREQUENCY TRANSMITTING AND RECEIVING ANTENNA

BACKGROUND OF THE INVENTION

This invention is directed to a radio frequency transmitting and receiving antenna which has initial high propagation efficiency and remains functional without significant deterioration of propagation characteristics after much of the top portion thereof is blasted away.

A critical part of any radio frequency communication system is the antenna. Both the transmitting and receiving antenna must be operative in order for the system to work. It is desirable for many communication systems to operate even though the antenna is subject to destructive forces. In this nuclear weapons age, a reliable communications system must have antennas which will remain operative after being subjected to the blast effects of high explosive or atomic weapons. One present practice to achieve "hardened" survivable or blast-resistant antennas is to bury them under large overburdens of blast-resistant material such as concrete. While this protects the antenna, the required propagation through the overburden results in a large signal loss, often six to twelve decibels, at each antenna. In the transmitter, the signal loss must be made up by increased transmitting power, which requires significantly larger equipment and significantly more input energy. Thus, both capital and operating costs are increased. Furthermore, the loss through the overburden above the antenna is greater with higher communication frequency. Losses in the very high frequency communication bands are much larger than in the low frequency bands.

SUMMARY OF THE INVENTION

In order to aid in the understanding of this invention, it can be stated in essentially summary form that it is directed to a buried radio frequency transmitting and receiving antenna comprising an antenna which is highly erodible by being arranged with a portion thereof near the earth's surface with the antenna extending into the earth, together with structure such that, when the upper portion undergoes major erosion, the remaining operative portion, now near the earth's surface, remains operative and without significant functional degradation.

It is an object and advantage of this invention to provide an antenna structure which is capable of transmitting and receiving radio frequency energy, and is of such nature that a substantial portion thereof can be blasted away without significant interference with radio frequency characteristics of the antenna.

It is another object and advantage of this invention to provide an erodible radio frequency antenna which, when buried in the earth, will have its top portion substantially flush with the ground surface and structured so that, when much of the top portion thereof is blown away, the remaining structure operates without significant deterioration of its electromagnetic properties.

It is another object and advantage of this invention to provide an antenna design which is capable of being embodied in antennas having different directional and/or frequency characteristics.

It is a further object and advantage of this invention to provide an antenna which is initially an efficient electromagnetic propagator and, after erosion of a substantial portion of the antenna, it remains an electromagnetic propagator so as to conserve on transmitter power capacity and power consumption.

Other objects and advantages of this invention will become apparent from a study of the following portion of this specification, the claims and the attached drawings.

DESCRIPTION OF THE PREFERRED EMBODIMENTS

Figure 1:
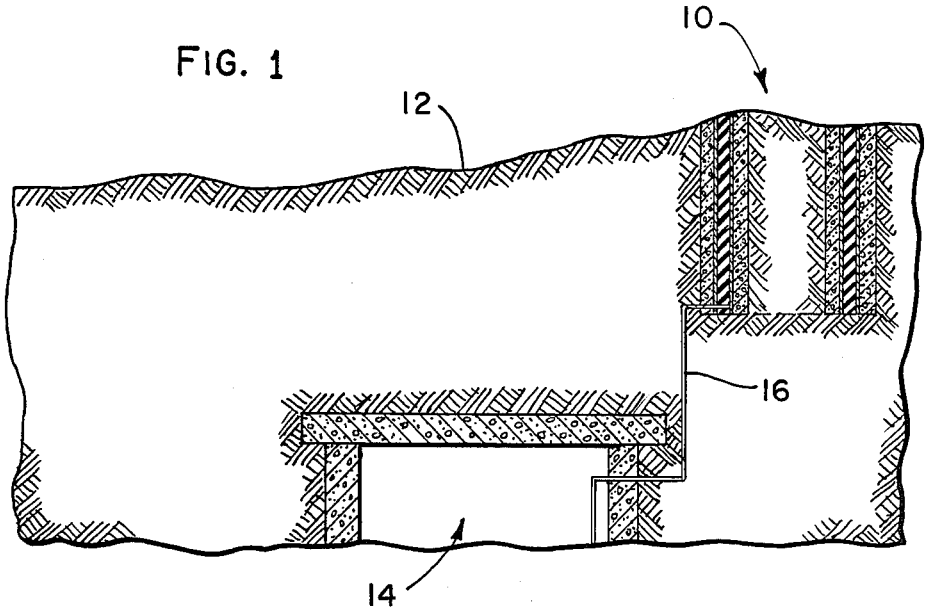
FIG. 1 is a vertical section through a portion of the earth adjacent its surface showing a first preferred embodiment of the erodible buried radio frequency transmitting and receiving antenna of this invention, before erosion.
Figure 2:
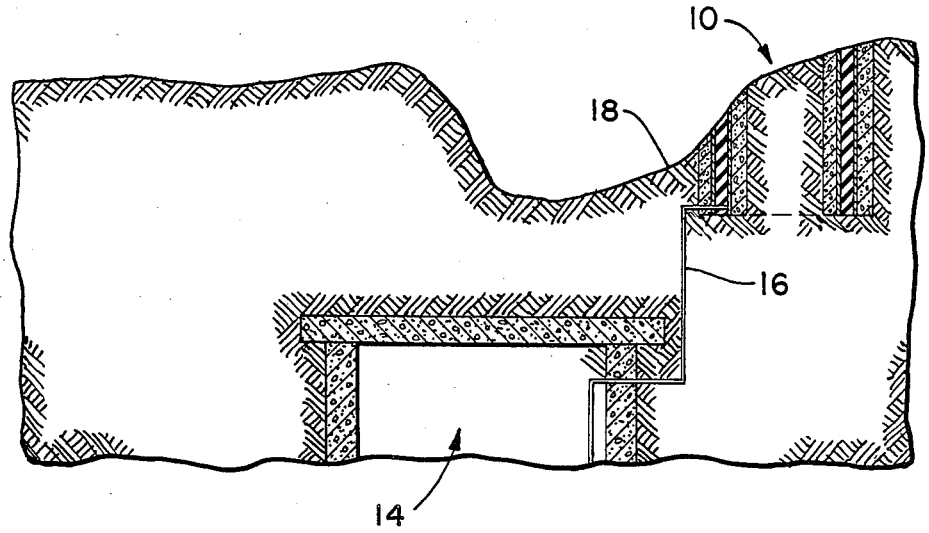
FIG. 2 is a similar figure showing the antenna after erosion thereof.

FIGS. 1 and 2 show a system which employs the first preferred embodiment of the erodible buried radio frequency transmitting receiving antenna of this invention. The antenna is generally indicated at 10 in FIGS. 1 and 2. The antenna 10 is an example of an annular ring antenna buried in the ground. The antenna itself is shown in more detail in FIG. 3. FIGS. 1 and 2 show a section through the ground with a communications bunker 14 buried beneath the ground surface so as to be blast-resistant. The antenna 10 is illustrated as having its top originally constructed to be level with the ground surface. In actuality, the top can extend a short distance above the ground surface or can be buried a short distance below the ground surface. The antenna 10 is connected by means of communication lines 16 to the bunker which contains the radio frequency transmitting and/or receiving equipment. The bunker is sufficiently deeply buried that it can provide safety to the personnel and equipment against bomb-blast. FIG. 2 shows the same structure after a blast. The new ground surface contour 18 passes at a new level through the antenna 10 below the old top of the antenna. The upper portion of the original antenna 10 has been blasted away down to the new ground surface level. However, even though a major portion of the antenna has been destroyed, the antenna 10 still maintains at high radiation efficiency. It is in this environment that the antenna 10, described in more detail in FIG. 3, is employed.

Antenna 10 is annular ring antenna which has inner and outer concentric tubular circular cylinders 20 and 22. The tubular cylinders are separated by a low-loss dielectric 24 of proper thickness and nature for the frequency involved. In order to provide major protection to the antenna so that it resists destruction, it has a protective core 26 and a protective shell 28. These may be made of concrete or the like. As is seen in FIG. 3, the core may be tubular if the antenna is of large diameter, merely in order to save materials, but in a smaller antenna, the core may be filled with concrete. The concrete is reinforced with the usual reinforcing steel bars conventional in the concrete art.

Figure 3:
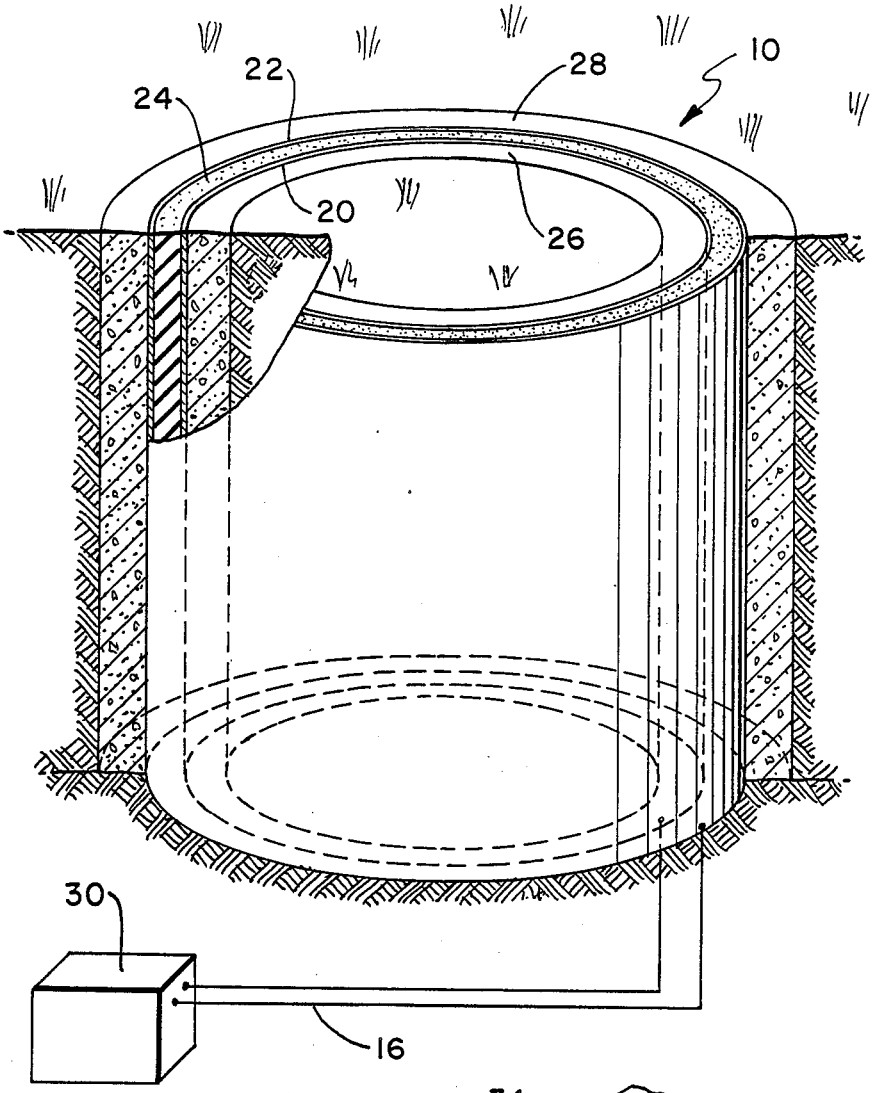
FIG. 3 is an enlarged side-elevational view of the first preferred embodiment of the erodible antenna of this invention, with parts broken away and parts taken in section.

FIG. 3 shows the antenna 10 connected by communication line 16 to the radio frequency transmitting and/or receiving equipment 30. The antenna 10 has a radiation pattern which is identical to a vertical wire antenna above the earth's surface. The antenna pattern is omnidirectional in the horizontal plane when the metal cylinders are small in diameter compared to the operating wavelength. The radiation is vertically polarized. Radio frequency energy is supplied to the two cylinders.

Figure 4:
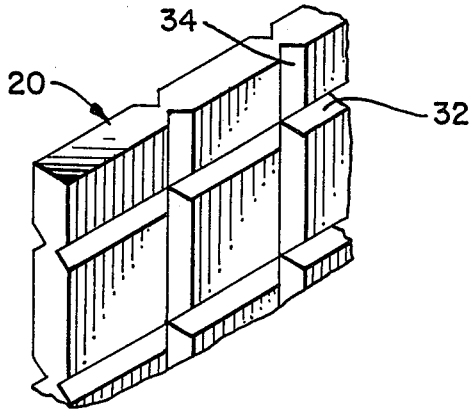
FIG. 4 is an isometric view of a first preferred material from which the antenna elements can be fabricated.
Figure 6:
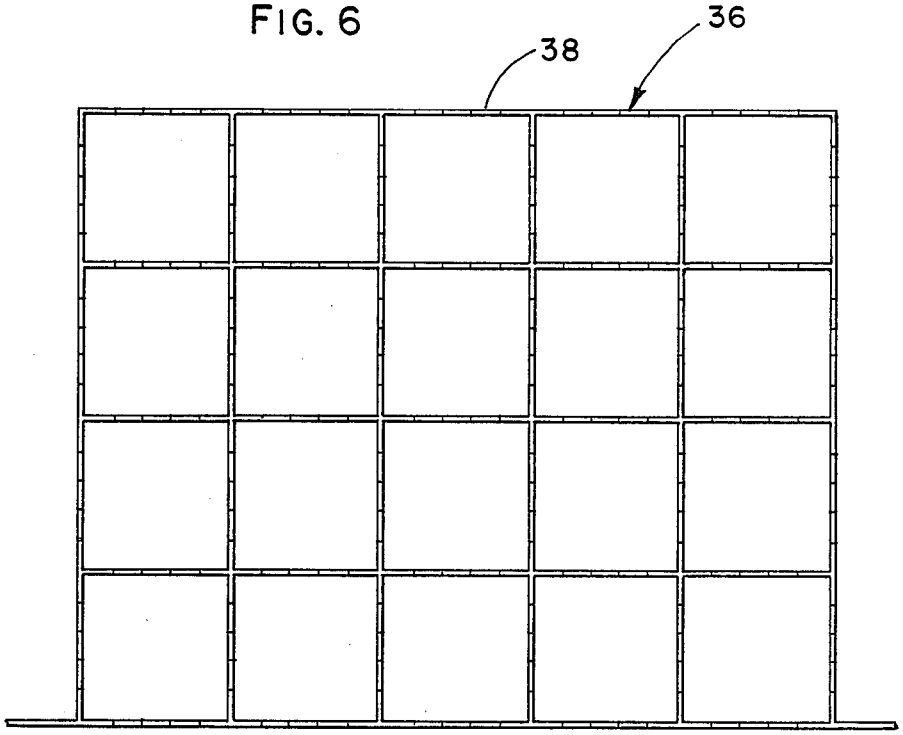
FIG. 6 is a side-elevational view of a metal mesh which is a second preferred metallic structure from which the antenna elements can be fabricated.

If the top portion of the antenna is blown away or otherwise eroded, the RF radiation pattern and efficiency remains nearly the same because the opening is nearly the same in electrical terms and the antenna depth is chosen so that the portion of the antenna remaining after a substantial portion is blasted away is adequate for good performance. However, the inner and outer cylinders must be electrically isolated, that is not shorted out with respect to each other. The metal antenna cylinders are preferably covered with a tough electrical insulator and are fabricated to fragment into pieces smaller than the spacing between the inner and outer cylinders. FIG. 4 shows cylinder plate material which has a series of grooves 32 and 34 which are spaced sufficiently close so that the cylinder 20 fragments into pieces smaller than the spacing between the cylinders. This prevents the shorting out of the antenna elements as a result of the blast. The cross-hatch grooves 32 and 34 may be applied to both sides of the cylinder, as shown, if required to provide the desirable frangibility. However, the cylinders must have sufficient strength that the severe shock of a blast does not break up the cylinders in place in ground. The major part of the strengthening for this purpose comes from the protective core and shell. As seen in FIG. 6, another way of constructing the cylinders 20 and 22 is to form an antenna element 36, with the structural parts of the antenna fabricated as a mesh of metal wires. The mesh openings may be as large as a quarter wavelength square. The mesh of antenna element 36 is formed of metallic wire 38, which has a series of notches 40 therein so that it is frangible at the notches under sufficient stress. The notches are spaced more closely together than the distance between the inner and outer antenna cylinders. The mesh antenna element 36 is preferably coated with a tough dielectric.

Figure 5:
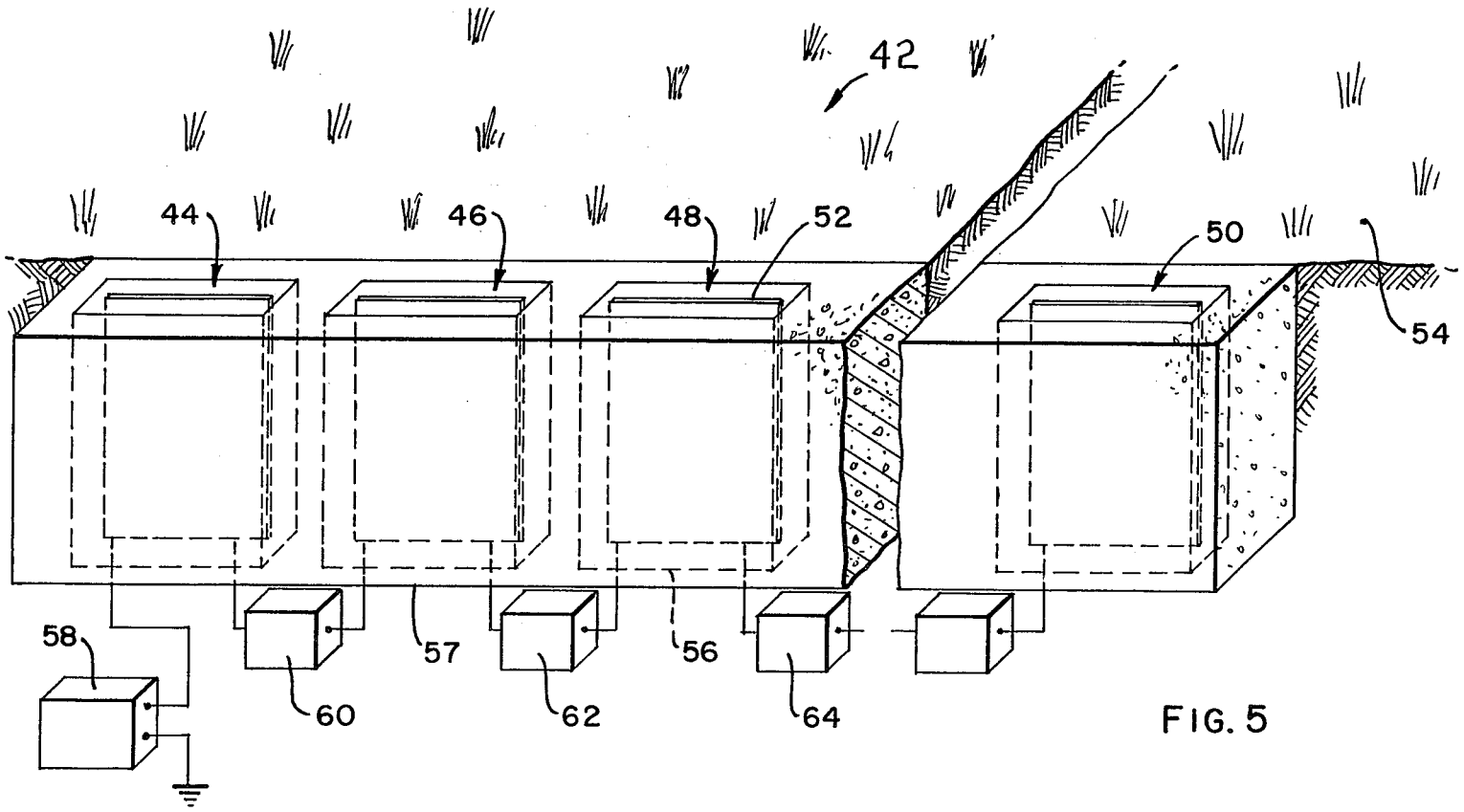
FIG. 5 is a second preferred embodiment of the erodible antenna of this invention, shown in the configuration of a fast-wave antenna.
Figure 7:
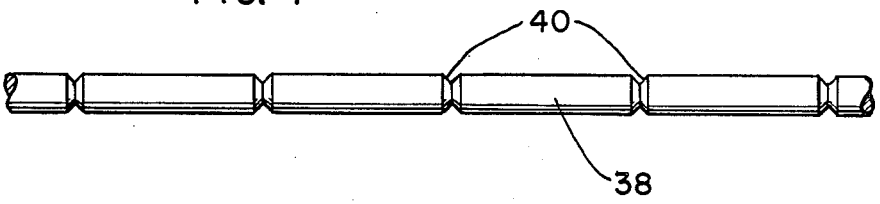
FIG. 7 is an enlarged side-elevational view of the wire from which the mesh of FIG. 6 can be fabricated.

FIG. 5 shows the second preferred embodiment of the erodible RF antenna of this invention. Fast-wave antenna 42 is made up of a plurality of segments, of which four segments 44, 46, 48 and 50 are shown. Each of the antenna segments comprises a plate, with a plate 52 identified in segment 48. Plate 52 is a substantially flat, planar plate which may be formed of the notched metal material of FIG. 4 or formed of the metal mesh such as is shown in FIG. 6. In either case, the plate is insulated with a tough dielectric and is fragmentable, as is indicated in FIGS. 4, 6 and 7. The several plates lie in a plane with the top edge substantially even with the surface 54 of the ground. Each of the plates is protected against mechanical destruction by being encased in a strong, preferably dielectric material. The encasement of plate 52 is indicated at 56. Each of the plates is of rectangular construction with the dimensions determined by the desired radio frequency properties and the depth required to achieve survivability. The first segment is fed by transmitter 58, the other side of which is grounded to earth ground. Series capacitors 60 and 62 serially connect segment 44, 46 and 48. Capacitor 64 connects plate 52 to succeeding plates in the array. When the antenna array is several wavelengths long, it radiates a highly directional beam. It radiates a vertically polarized beam off of the right end, as seen in FIG. 5, when the left-end segment is fed with a radio frequency signal with respect to ground, as indicated by transmitter 58. The series capacitors are added to speed up the wave velocity along the antenna and thereby increase the radiation efficiency. The dielectric material on either side of the conducting plates is made extensive enough to lower ground losses. The encasement 56 in FIG. 5 is a dielectric encasement. In addition, the encasement 57 is a structural encasement such as concrete or earth.

Should the upper portion of any one or more of the elements of the array be eroded, by blast or otherwise, the portions of the plate which are freed from the remaining plate are sufficiently small that they do not cause shorting or propagation problems. The remaining plate structure still in the ground continues to be an efficient radiator for applied radio frequency signals. That portion of a plate that is at the earth's surface before the blast and that portion at the earth's surface after the blast are the portions which produce the major part of the antenna radiation.

Figure 8:
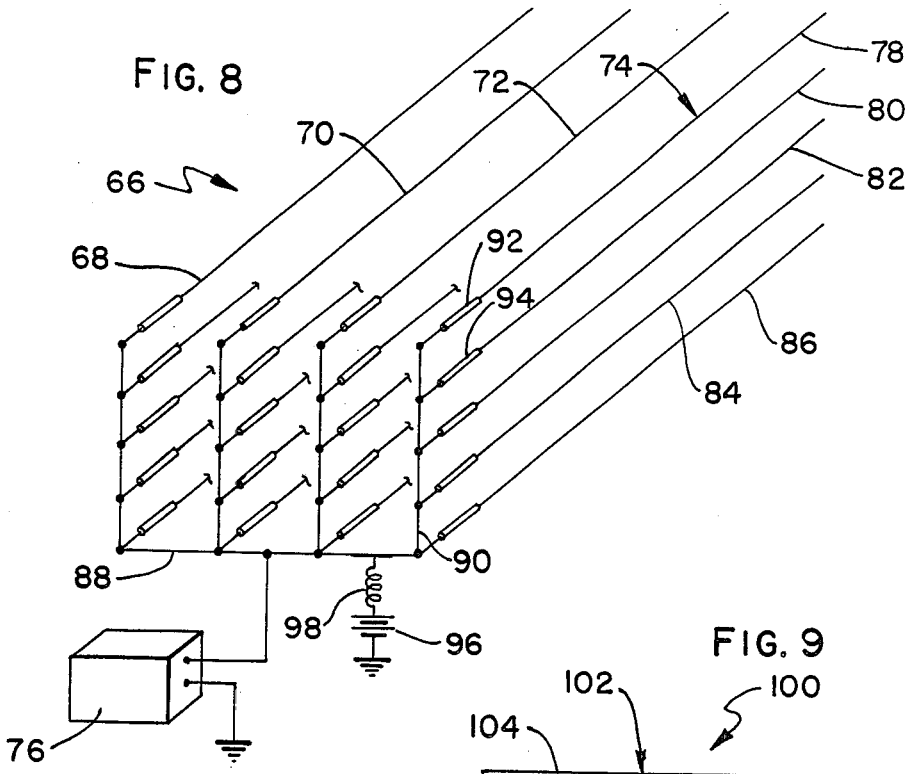
FIG. 8 is a perspective view of a third preferred embodiment of the erodible antenna of this invention, shown as unterminated wire arrays.

FIG. 8 illustrates antenna system 66 which illustrates a third preferred embodiment of the erodible radio frequency antenna of this invention. A plurality of antenna arrays is connected together to act in cooperation with each other. Four arrays 68, 70, 72 and 74 are illustrated in FIG. 8. These arrays are connected together and are fed from a single transmitter 76. A single array 74 illustrates the antenna of this invention, but the plurality of arrays increases the radiation efficiency by near N times for N arrays, providing the arrays are separated by four skin depths. Array 74 is closest to the viewer and is illustrative of the other arrays. Array 74 is comprised of five separate antenna elements. Elements 78, 80, 82, 84 and 86 are each a single insulated wire. The antenna elements are stacked in a vertical plane with the top element 78 substantially at ground surface. Transmitter 76 is grounded on one side and feeds signals through bus 88 and bus 90 to all of the elements 78 through 86. When the top of the antenna 66 is eroded, one or more of the antenna elements, starting from the top, may be destroyed. However, the remaining elements maintain transmission efficiency.

If one or more of the elements is shorted to ground, it must be disconnected so that it does not absorb power which otherwise could be radiated. In order to prevent this loss through short-circuiting, each of the elements has a fuse serially connected therein between the bus and the element. Fuses 92 and 94 are shown interconnecting the elements 78 and 80 to bus 90. Battery 96 is connected on one side to ground and on the other side through inductor 98 to bus 88. The inductor is to keep the RF energy out of the battery. However, the entire antenna system is biased with respect to ground by battery 96. Should one of the antenna elements become shorted to ground, the current supplied by the battery would blow out the corresponding fuse. Thus, the remaining portions of the antenna system and the array remain operative, while the damaged element is disconnected from the transmitter.

As an alternative to the fuse-battery disconnect system described in FIG. 8, biased diodes could be reverse biased upon short to disconnect a shorted line. A diode has a low resistance when biased on and a high resistance when biased off. If diodes are selected to have low resistance when the wires are not shorted to ground, then when a short occurs, the supply voltage 96 will cause that diode to develop a high resistance to RF. Reverse biasing with a DC source would increase resistance to the RF source and prevent that line from accepting energy from the RF transmitter when that wire is shorted.

Figure 9:
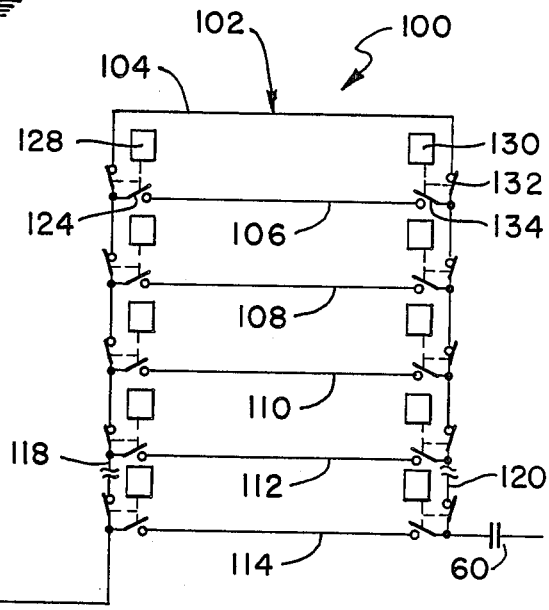
FIG. 9 is a schematic diagram of another preferred embodiment of a segment of a fast-wave antenna in accordance with this invention.
Figure 10:
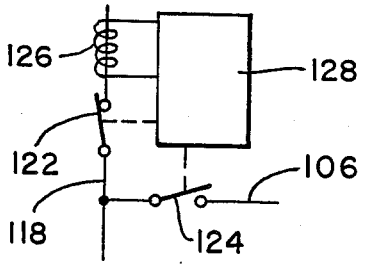
FIG. 10 is a schematic diagram of a decoupling sensor employed in the antenna segment of FIG. 9.

FIG. 9 shows an embodiment of an erodible fast-wave radio frequency antenna, which is generally indicated at 100. The structure illustrated corresponds to a single plate of the antenna 42. In this embodiment, single array 102 is illustrated as being a vertical stack of antenna elements corresponding to the plate in segment 44. The antenna elements 104, 106, 108, 112 and 114 are each single insulated wires. In the array or segment 102, sensing circuitry is used to determine the radiation integrity of each antenna element. Only the topmost good antenna element is employed. If the top element becomes electrically open or shorted to ground, the sensors cause the top element to be replaced by the first good element below it. The elements are stacked in the ground in a plane, with the top element at or near the ground surface. Transmitter 116 feeds buses 118 and 120 which have serial switches therein. The serial switch is positioned above each antenna element in each bus. Furthermore, each antenna element has a switch at each end thereof where it is connected to the bus. FIG. 10 illustrates in enlarged detail the switches 122 and 124 which are respectively in bus 118 above antenna element 106 and in antenna element 106 adjacent its connection to bus 118. Sensor 126 senses the transmission of RF power upward through bus 118 and through element 104. Switch 122 is normally closed, and switch 124 is normally open, to permit the transmitter signal to pass upward to element 104. Sensor 126 senses this signal power and maintains switch 122 closed and switch 124 open. Should element 104 become shorted to ground or open, due to erosion, blast or other circumstance, sensor 126 would sense this condition. Sensor 126 is connected to processor and actuator 128 which, under those conditions, would open switch 122 and close switch 124. Actuator 130, see FIG. 9, is connected to switches 132 and 134. Actuator 130 is connected to actuator 128 to be actuated at the same time as actuator 128. When switch 122 is closed, switch 132 is also closed. Similarly, when switch 124 is open, switch 134 is also open. When sensor 126 operates actuator 128 to open switch 122 and close switch 124, a signal is also transmitted to actuator 130 to open switch 132 and close switch 134. Each of the pairs of switches shown in FIG. 9 is provided with an actuator, and the actuators are controlled so that, when an element thereabove is shorted or open, the upper part of the array is disconnected from the transmitter. At the same time, the topmost operative element is connected to be actuated. In the embodiment of FIG. 9, only one antenna element is connected to be powered by the transmitter, and that element is the topmost operative element in the array. The antenna 100 is buried in the ground, with its topmost element adjacent the ground surface. Furthermore, additional segments or arrays are buried in alignment to each other, in a plane in the same manner as described with respect to FIG. 5 in order to increase propagation velocity.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A fast-wave radio frequency antenna comprising a plurality of upright plates arranged generally in a plane so that said antenna has a top and a bottom and has a height extending from said top to said bottom of said antenna, said top and said bottom of said antenna each being configured to be efficiently interactive with radio frequency energy, the height of said antenna from said top to said bottom being sufficient so that when said antenna is buried in the ground with said top adjacent the soil surface, said bottom is sufficiently below the level surface so that a majority thereof can be eroded away by blast and the remaining portion of said plates remain an efficient radiator, said plates being frangible means for breaking into pieces smaller than the spacing between said plates when subject to erosion due to blast.

2. The antenna of claim 1 wherein said antenna comprises a plurality of plates, each comprising an antenna element, and said antenna elements are buried in the ground in such a position as to be substantially parallel to each other to form an array of elements having reater radiation efficiency than a single upright plate and having greater beam directivity than a single upright plate.

3. A fast-wave radio frequency antenna comprising a plurality of upright plates arranged generally in a plane so that said antenna has a top and a bottom and has a height extending from said top to said bottom of said antenna, said top and said bottom of said antenna each being configured to be efficiently interactive with radio frequency energy, the height of said antenna from said top to said bottom being sufficient so that when said antenna is buried in the ground with said top adjacent the soil surface, said bottom is sufficiently below the level surface so that majority thereof can be eroded away by blast and the remaining portion of saidplates remain an efficient radiator, wherein said plates are made of sheet material having stress-raising grooves therein for breaking into pieces smaller than plate spacing when subject to erosion due to blast.

4. The antenna of claim 3 wherein said antenna comprises a plurality of plates, each comprising an antenna element, and said antenna elements are buried in the ground in such a position as to be substantially parallel to each other to form an array of elements having greater radiation efficiency than a single upright plate and having greater beam directly than a single upright plate.

5. A fast-wave radio frequency antenna comprising a plurality of upright plates arranged generally in a plane so that said antenna has a top and a bottom and has a higher extending from said top to said bottom of said atenna, said top and said bottom of said antenna each being configured to be efficiently interactive with radio frequency energy, the height of said antenna from said top to said bottom being sufficient so that when said antenna is buried in the ground with said top adjacent the soil surface, said bottom is sufficiently below the level surface so that a majority thereof can be eroded away by blast and the remaining portion of said plates remain an efficient radiatior, wherein said plates are made of a wire mesh having stress-raising grooves therein for breaking into pieces smaller than plate spacing when subject to erosion due to blast.

6. The antenna of claim 5 wherein said antenna comprises a plurality of plates, each comprising an antenna element, and said antenna elements are buried in the ground in such a position as to be substantially parallel to each other to form an array of elements having greater radiation efficiency than a single upright plate and having greater beam directivity than a single upright plate.

7. An antenna comprising:

a plurality of antenna wires, said wires being arranged substantially parallel to each other and one above the other, each of said wires having a feed end so that each wire is an antenna element having its own interactivity with radio frequency energy and said wires being connected together at said feed end so that said plurality of antenna elements forms an antenna array for being buried in the ground with the topmost antenna element of said array being at the ground surface so that upon burying of the lower elements of said antenna array and erosion of the ground at the surface, some of the lower elements of said array remain buried to remain effective; and means for disconnecting such antenna elements of said array as become shorted.

8. The antenna of claim 7 wherein said antenna elements are fed from one end, and said means for disconnecting comprises disconnecting said fed end when an antenna element becomes shorted.

9. The antenna of claim 7 wherein said wires are connected at both ends and such wires as are shorted are disconnected at both ends.

10. The antenna of claim 7 wherein only the top radiating element of said antenna is connected and said means for disconnecting includes means for connecting the next lower antenna element when the connected radiating element becomes shorted or non-radiating and is disconencted by said means for disconnecting.

11. The antenna of claim 7 wherein said antenna comprises a plurality of stacked elements buried in the ground with its top element substantially at the ground surface and said antenna is connected to a radio frequency device buried in the ground so that both said antenna and said radio frequency device are protected against destruction due to soil surface erosion.

12. The antenna of claim 7 wherein said antenna elements are fed from one end and said means for disconnecting an antenna element includes means for connecting the next lower antenna element.

13. The antenna of claim 7 wherein there is a plurality of said antenna arrays, and said arrays are buried so that they are substantially parallel to each other for providing increased radiation efficiency and increasing beam directivity as compared to a single array.

14. The antenna of claim 8 wherein there is a plurality of said antenna arrays, and said arrays are buried so that they are substantially parallel to each other for providing increased radiation efficiency and increasing beam directivity as compared to a single array.

15. The antenna of claim 9 wherein there is a plurality of said antenna arrays, and said arrays are buried so that they are substantially parallel to each other for providing increased radiation efficiency and increasing beam directivity as compared to a single array.

* * * * *